US010910716B2

(12) United States Patent
Pong

(10) Patent No.: US 10,910,716 B2
(45) Date of Patent: Feb. 2, 2021

(54) RFID INFINITY ANTENNA

(71) Applicant: Sato Holdings Kabushiki Kaisha, Tokyo (JP)

(72) Inventor: Tai Wai Pong, St Peters (AU)

(73) Assignee: SATO HOLDINGS CORPORATION, Tokyo (JP)

( * ) Notice: Subject to any disclaimer, the term of this patent is extended or adjusted under 35 U.S.C. 154(b) by 158 days.

(21) Appl. No.: 15/547,233

(22) PCT Filed: Jan. 29, 2015

(86) PCT No.: PCT/JP2015/053162
§ 371 (c)(1),
(2) Date: Jul. 28, 2017

(87) PCT Pub. No.: WO2016/121130
PCT Pub. Date: Aug. 4, 2016

(65) Prior Publication Data
US 2018/0013201 A1 Jan. 11, 2018

(51) Int. Cl.
*H01Q 7/00* (2006.01)
*H01Q 1/22* (2006.01)
(Continued)

(52) U.S. Cl.
CPC ..... *H01Q 7/005* (2013.01); *H01Q 1/2216* (2013.01); *H01Q 1/243* (2013.01); *H01Q 7/00* (2013.01); *H01Q 21/245* (2013.01); *H01Q 21/30* (2013.01)

(58) Field of Classification Search
CPC ..... H01Q 1/2216; H01Q 7/005; H01Q 9/26; H01Q 9/285
See application file for complete search history.

(56) References Cited

U.S. PATENT DOCUMENTS 3,736,591 A 5/1973 Rennels et al.
4,518,965 A 5/1985 Hidaka
(Continued)

FOREIGN PATENT DOCUMENTS

CN 101034765 A 9/2007
CN 102119453 A 7/2011
(Continued)

OTHER PUBLICATIONS

International Search Report dated Mar. 31, 2015, issued in counterpart International Application No. PCT/JP2015/053162 (2 pages, including cover sheet).
(Continued)

*Primary Examiner* — Daniel Munoz
(74) *Attorney, Agent, or Firm* — Westerman, Hattori, Daniels & Adrian, LLP

(57) ABSTRACT

An RFID antenna comprises two or more electroconductive sheets of uniform planar size, being parallel and aligned, with a space therein between. Each electroconductive sheet comprises: a feed connection point, which receives an electrical current from a feed to supply current to the electroconductive sheet; and a return connection point, opposite and parallel to the feed connection point of the electroconductive sheet, which acquires current from the electroconductive sheet and transfers current to a return. The electrical circuit pathway created from the feed to the return is equal distance for each electroconductive sheet. The two electroconductive sheets are connected together to complete a circuit that causes direction of electrical flow in the one electroconductive sheet to be opposite to direction of electric flow in the other electroconductive sheet.

14 Claims, 10 Drawing Sheets

100

(51) Int. Cl.

| | |
|---|---|
| ***H01Q 1/24*** | (2006.01) |
| ***H01Q 21/24*** | (2006.01) |
| ***H01Q 21/30*** | (2006.01) |

(56) References Cited

U.S. PATENT DOCUMENTS

| | | | | |
|---|---|---|---|---|
| 5,001,778 | A | 3/1991 | Ushiyama et al. | |
| 2003/0112193 | A1* | 6/2003 | Briggs | H01Q 7/005 343/742 |
| 2005/0179529 | A1 | 8/2005 | Sato | |
| 2007/0210976 | A1 | 9/2007 | Luk et al. | |
| 2008/0042846 | A1 | 2/2008 | Jenkins et al. | |
| 2008/0203163 | A1* | 8/2008 | Wakabayashi | G06K 7/0008 235/449 |
| 2008/0252423 | A1 | 10/2008 | Murdoch et al. | |
| 2009/0224778 | A1 | 9/2009 | Sato et al. | |
| 2010/0001914 | A1* | 1/2010 | Lavedas | H01Q 1/2216 343/742 |
| 2012/0162020 | A1* | 6/2012 | Fukunaga | H01Q 9/04 343/700 MS |
| 2013/0043315 | A1* | 2/2013 | Carr | H01Q 1/2225 235/492 |
| 2014/0008437 | A1* | 1/2014 | Wang | H01Q 1/2216 235/439 |

FOREIGN PATENT DOCUMENTS

| | | | |
|---|---|---|---|
| JP | 57-142002 | A | 9/1982 |
| JP | 2-126702 | A | 5/1990 |
| JP | 6-244618 | A | 9/1994 |
| JP | 2005269608 | A | 9/2005 |
| JP | 2007-129734 | A | 5/2007 |
| WO | 2008/065760 | A1 | 6/2008 |
| WO | 2009149471 | A1 | 12/2009 |

OTHER PUBLICATIONS

Written Opinion of the International Searching Authority dated Mar. 31, 2015, issued in counterpart International Application No. PCT/JP2015/053162 (4 pages, including cover sheet).

Extended European Search Report dated Jul. 20, 2018, issued in European Patent Application No. 15880025.0 (PCT/JP2015053162).

Office Action dated Oct. 7, 2019, issued in counterpart JP Application No. 2018-214362, with English Translation. (5 pages).

Office Action dated Apr. 17, 2020, issued in counterpart JP Application No. 2018-214362, with English Translation. (10 pages).

Office Action dated Apr. 2, 2020, issued in counterpart EP Application No. 15 880 025.0. (3 pages).

Office Action dated Aug. 26, 2019, issued in counterpart AU Application No. 2015379278. (5 pages).

Office Action dated Mar. 21, 2019, issued in counterpart CN Application No. 201580074925.3, with English Translation. (10 pages).

Translation of Office Action dated Nov. 18, 2019, issued in counterpart CNn Application No. 201580074925.3. (4 pages).

International Preliminary Report on Patentability (Form PCT/IB/373) issued in counterpart International Application No. PCT/JP2015/053162 dated Aug. 1, 2017, with Form PCT/ISA/237. (5 pages).

A first letter dated Aug. 13, 2019 from the CN associate, detailing a telephone conversation with the Examiner for the counterpart CN application No. 201580074925.3.

A second letter dated Oct. 21, 2019 from the CN associate, detailing a telephone conversation with the Examiner for the counterpart CN application No. 201580074925.3.

A third letter dated Feb. 26, 2020 from the CN associate, detailing a telephone conversation with the Examiner for the counterpart CN application No. 201580074925.3.

* cited by examiner

[Fig.1]
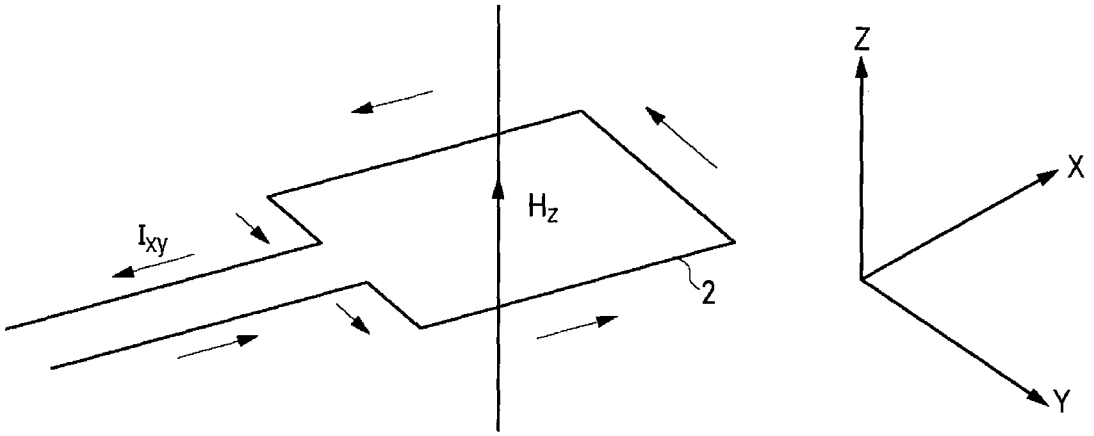
[Fig.2]
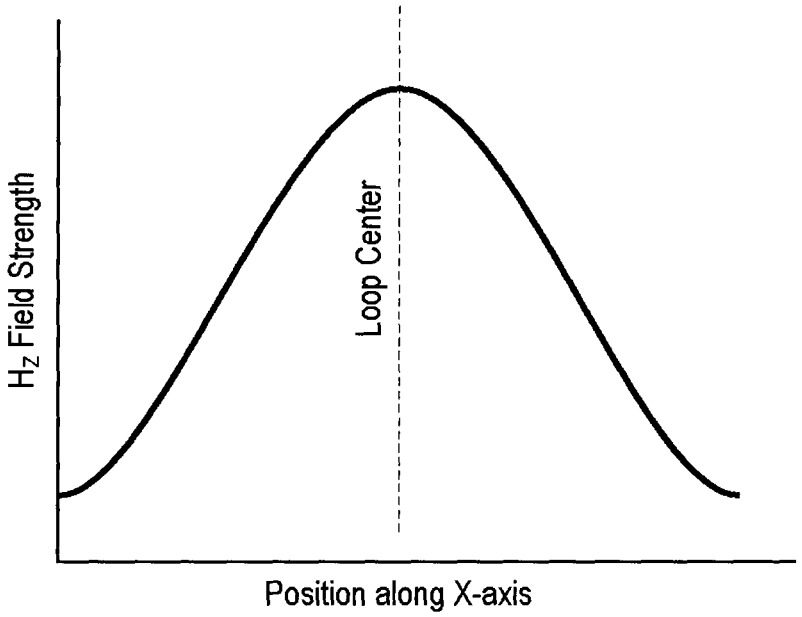

[Fig.3]
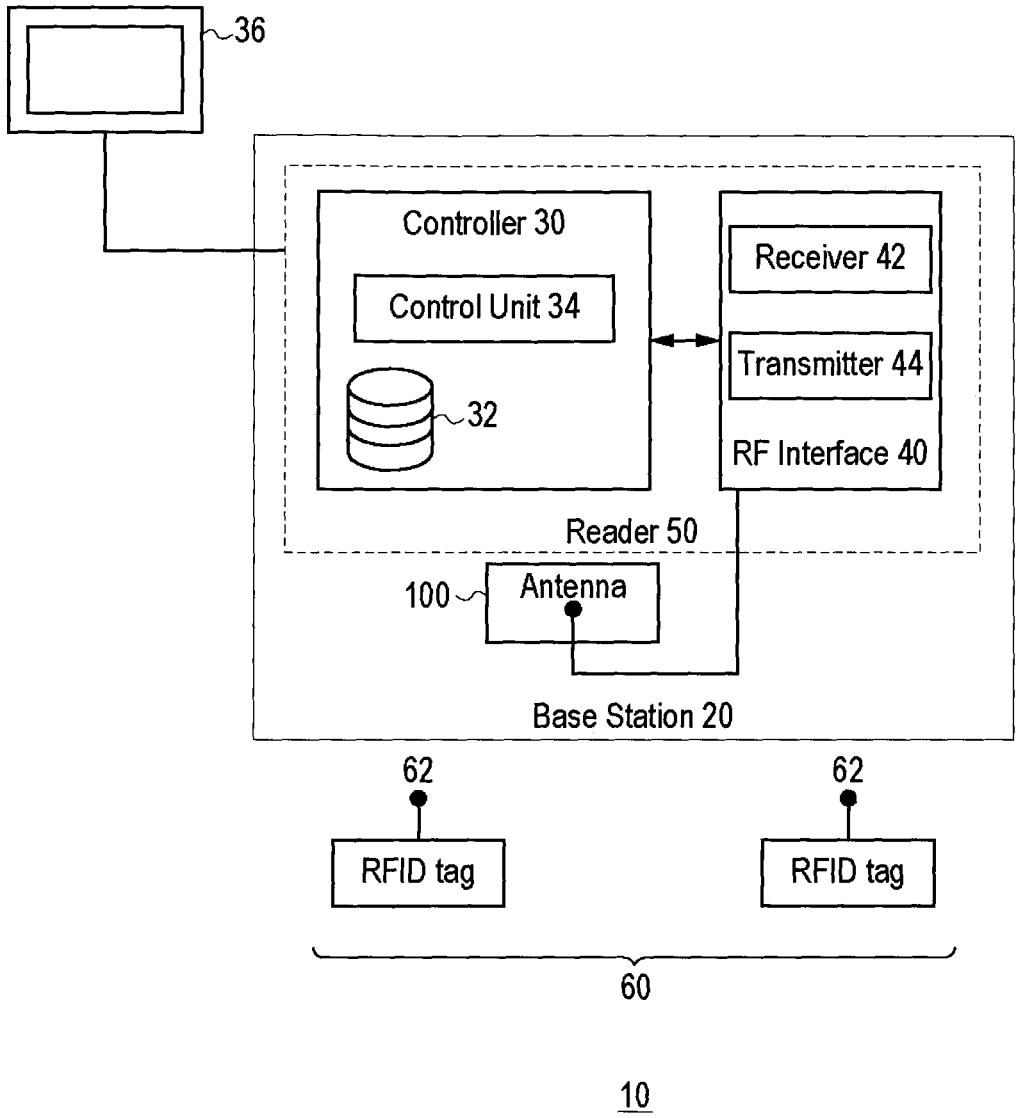

[Fig.4]
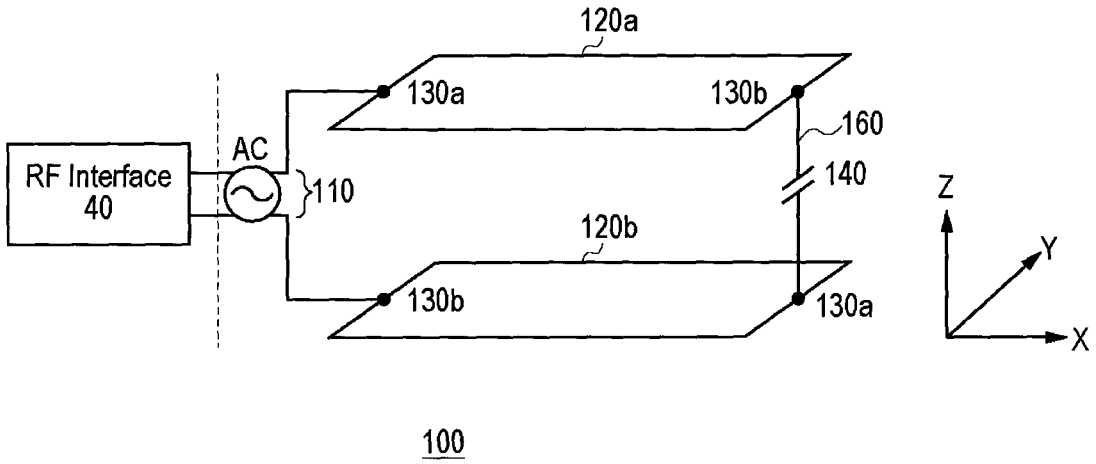

[Fig.5A]
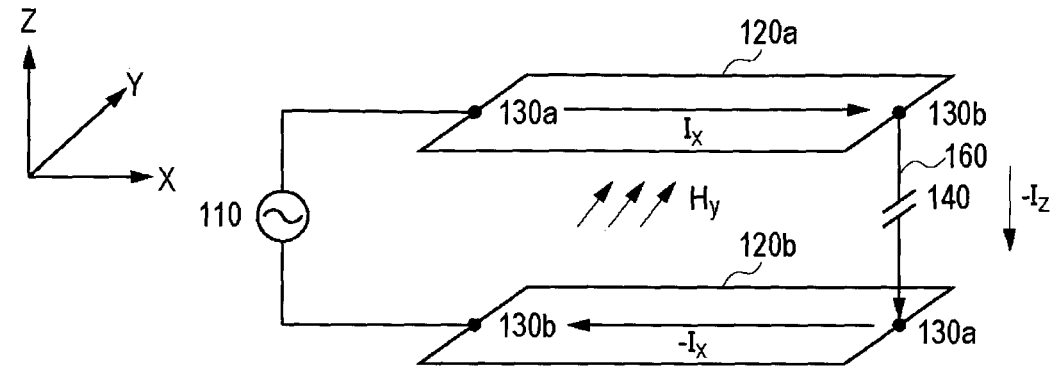
[Fig.5B]
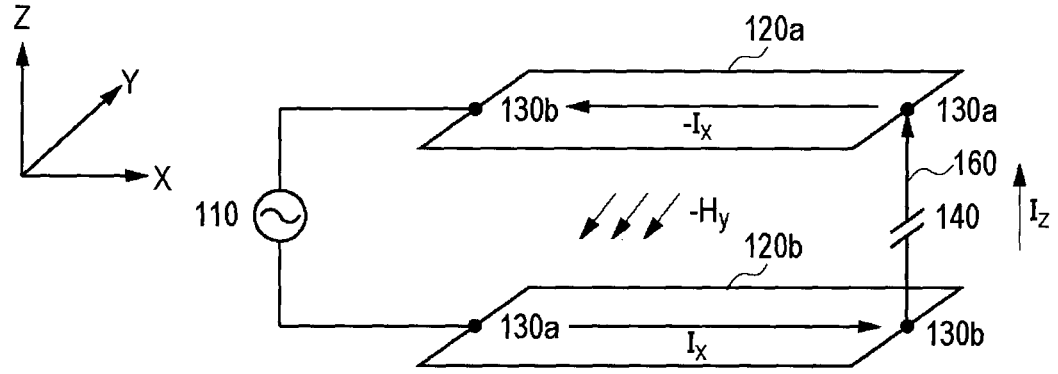
[Fig.5C]
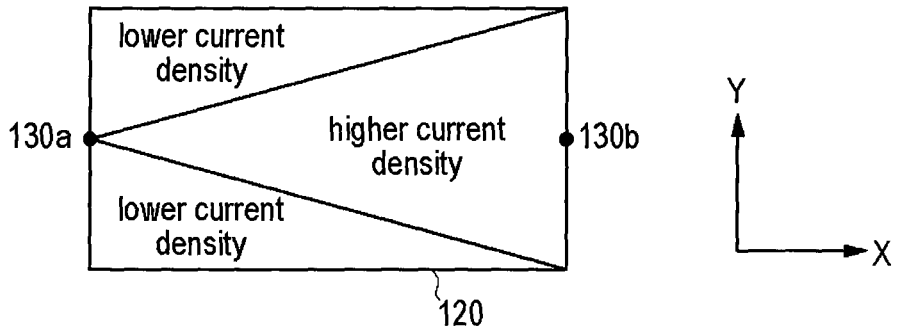

[Fig.6]
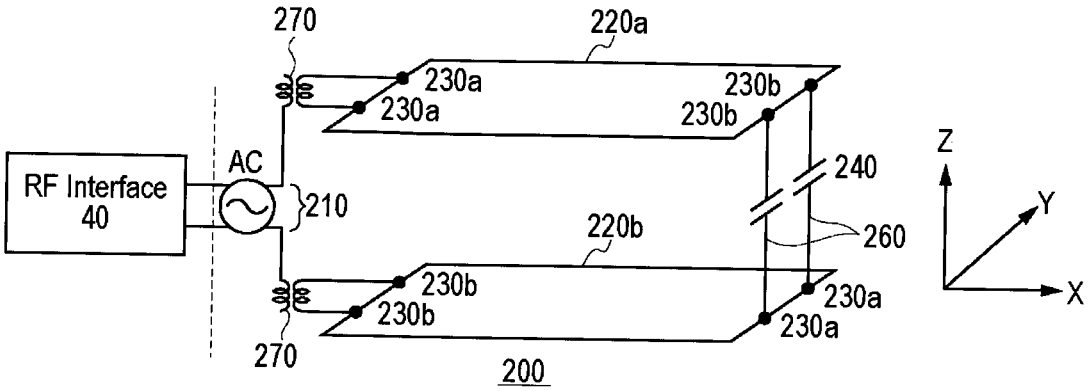
[Fig.7]
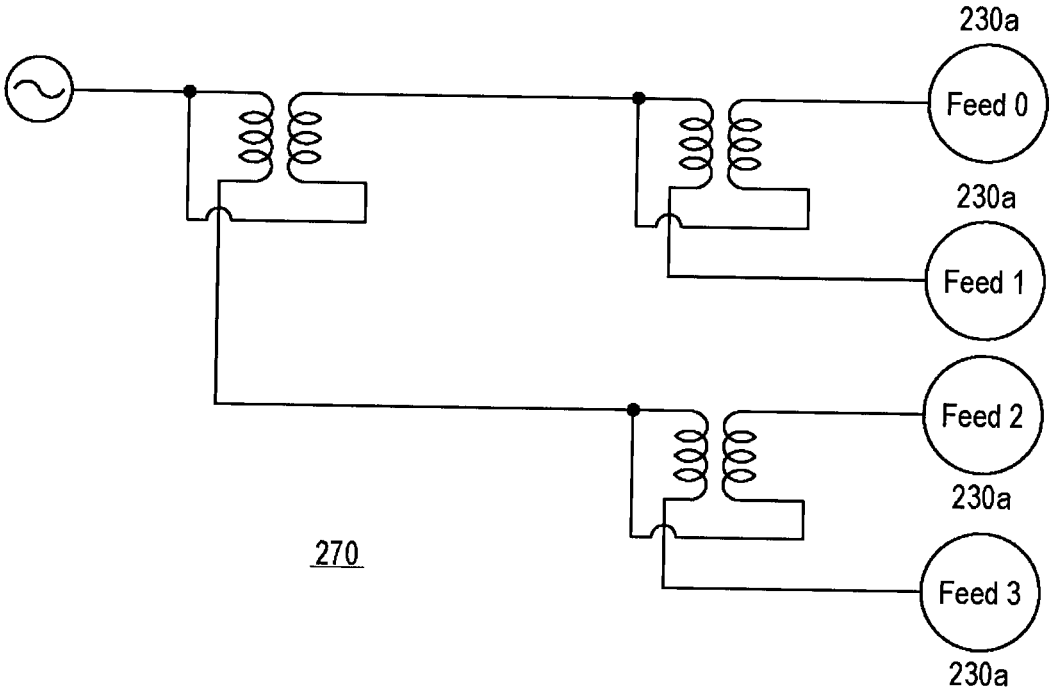

[Fig.8]
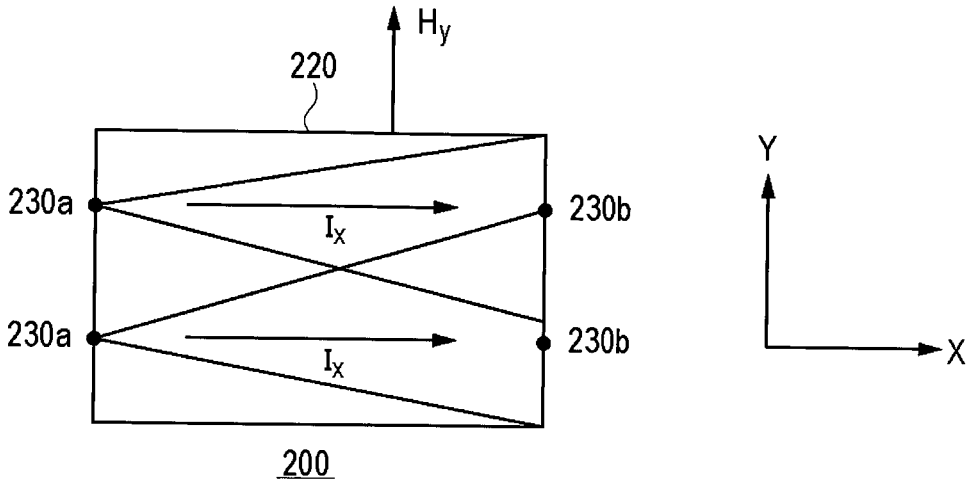
[Fig.9]
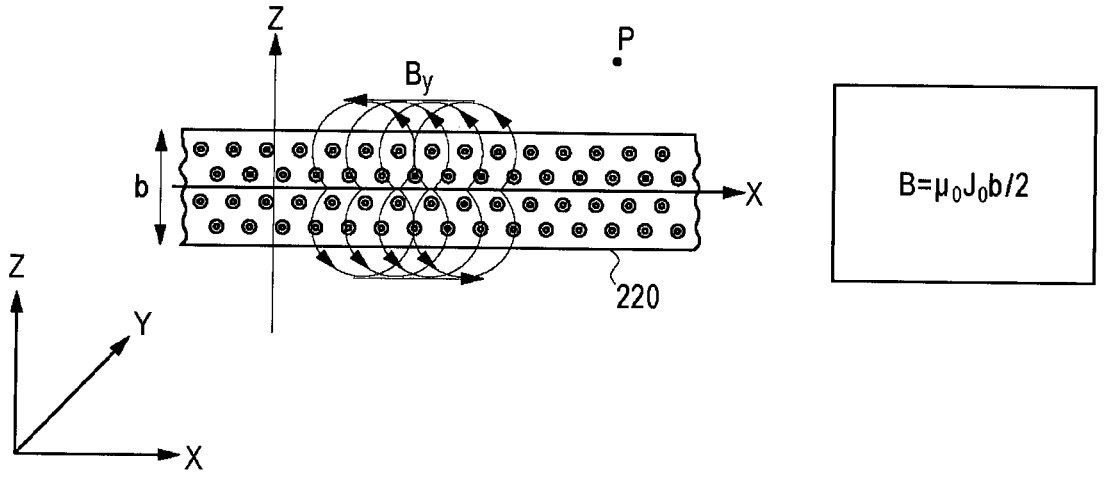

[Fig.10]
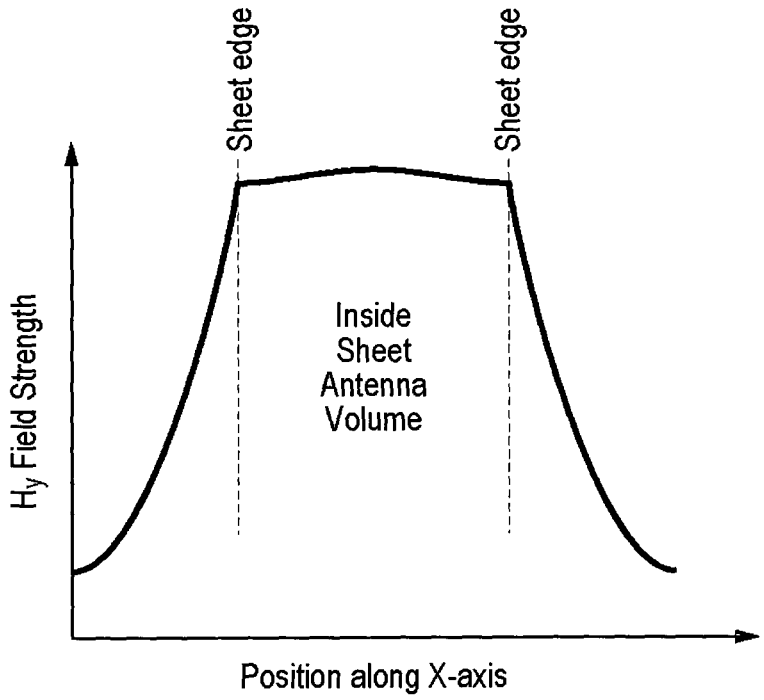
[Fig.11]
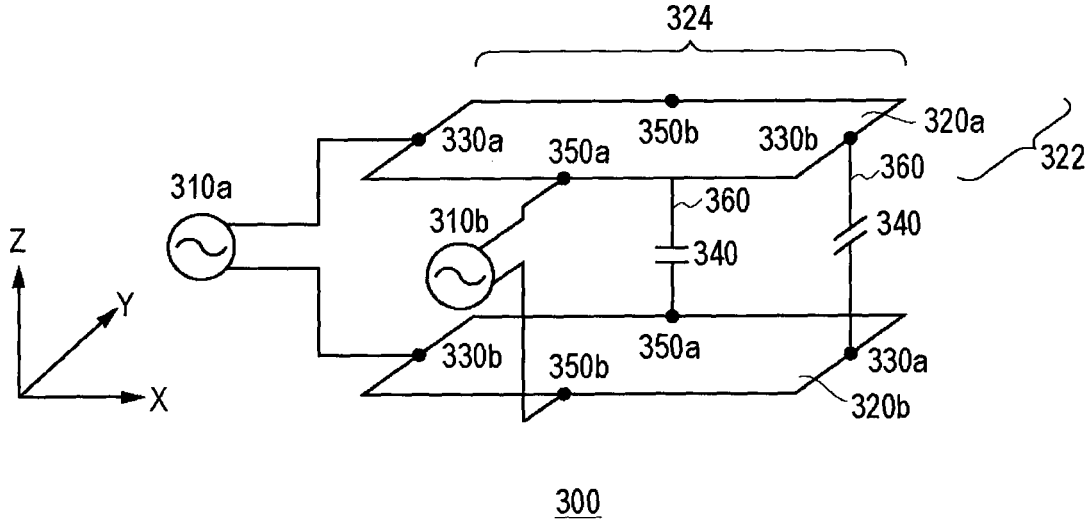

[Fig.12A]
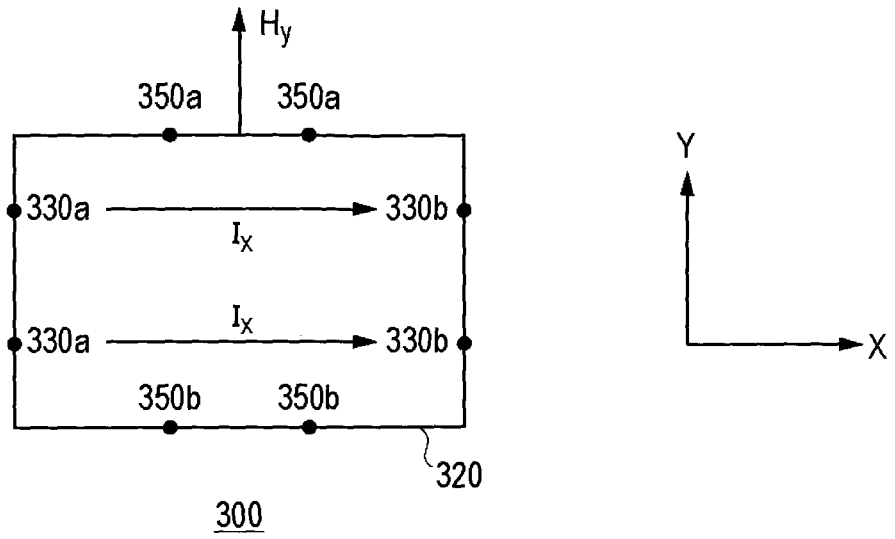
[Fig.12B]
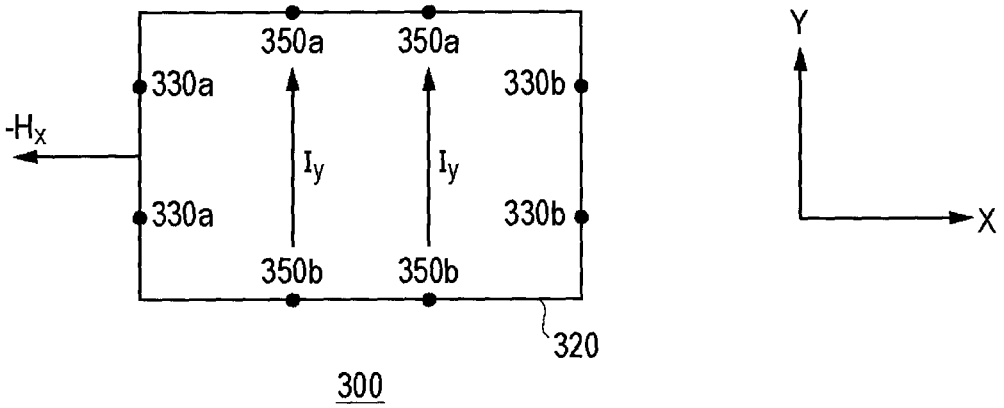

[Fig.13]
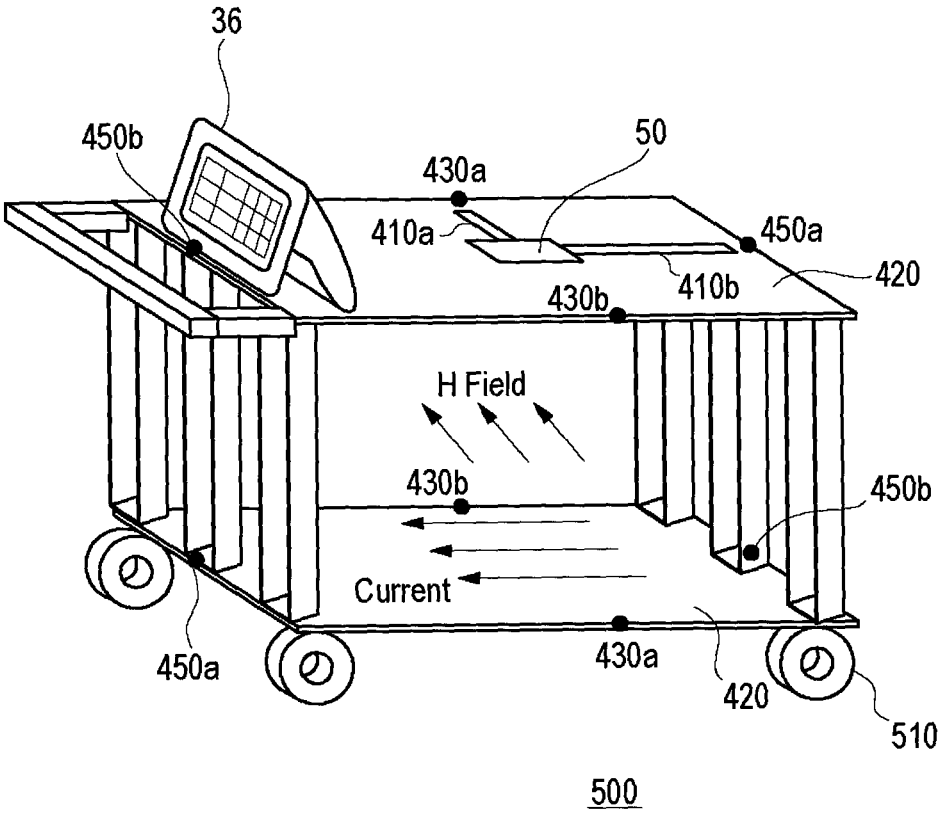

[Fig.14]
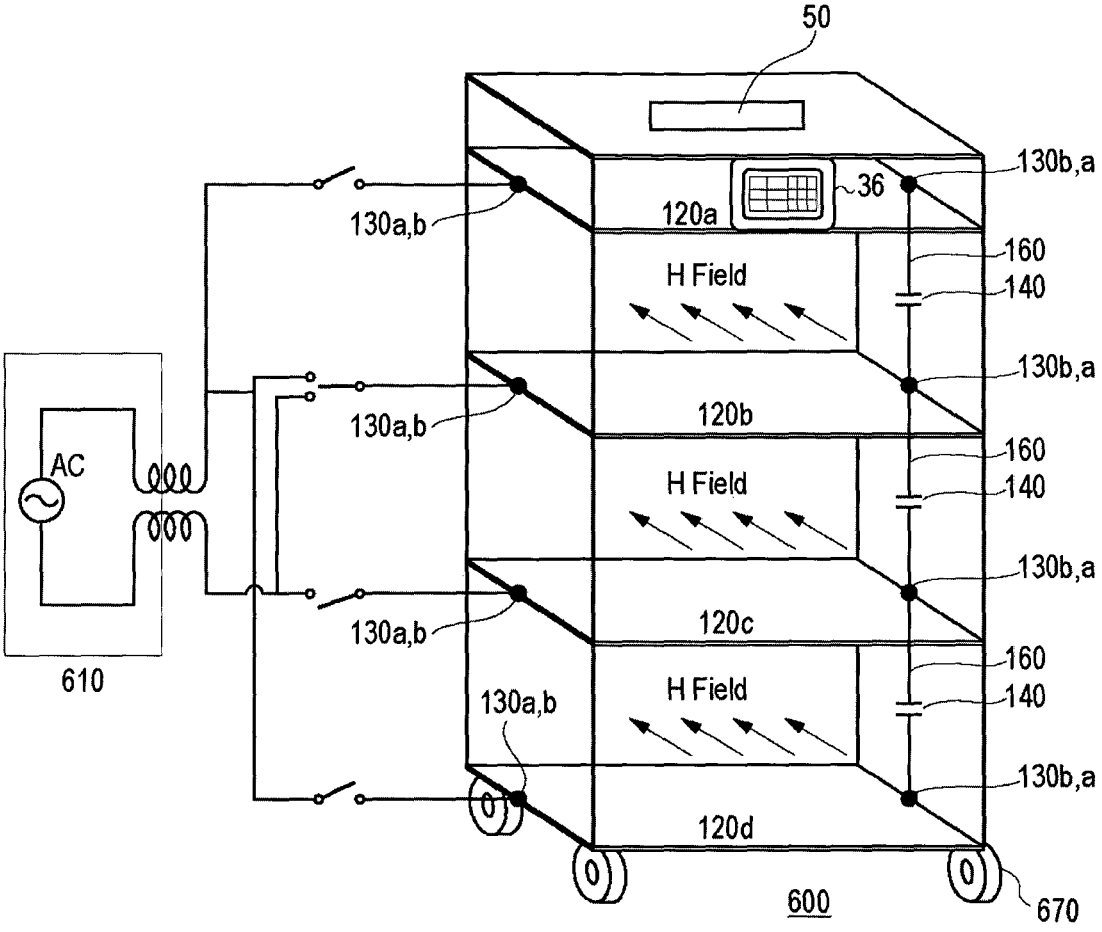

RFID INFINITY ANTENNA

TECHNICAL FIELD

The present invention relates to an RFID antenna and in particular an antenna with uniform magnetic field using two electroconductive plates.

BACKGROUND ART

Radio-Frequency Identification (RFID) technology has recently become widely used in many fields and is useful for many functions, such as for inventory and tracking of items. An RFID system is utilized with several components, with a typical RFID system including one or more RFID tags or labels and at least one RFID reader or transponder that detects the RFID labels. RFID readers will transmit and receive information to and from the tags; to do so, a reader will generally include a control unit that controls the reading of RFID tags and an antenna that communicates with an RFID tag.

In general, an antenna for a reader RFID system will be conventionally be formed as a loop antenna, i.e., with wires wound around a central point to form one or multiple turns of a loop through which electrical current (I) will travel. Such wires are activated with the electrical current to create an electromagnetic field, also known as a magnetic field, an "H field," or the related "B field," at the center of the loop. The generated magnetic field is instrumental in detecting and reading RFID tags in the RFID system.

RFID antennas like the aforementioned typically include a housing so as to shield the loop antenna from any outside interference that would disrupt the electromagnetic field. The housing, e.g., metal sheets protecting the RFID antenna, act to protect the internal electronics of the RFID antenna from any environmental noise as well as emission other than magnetic field generated by the antenna.

SUMMARY OF INVENTION

Technical Problem

However, it is understood that in conventional RFID antennas with loop formations, the read area for RFID tags to be detected is relatively limited. Each individual loop of a conventional loop antenna may only generate a magnetic field in one direction. Such as, for example, in a case where current is distributed through a loop antenna situated on a two-dimensional plane, a magnetic field shall be generated that is perpendicular to the two-dimensional plane, e.g., Z-axis H field from current I directed along a Cartesian X-Y plane. FIG. 1 shows the effect of current $I_{xy}$, being applied through a loop antenna 2 along the X-Y plane to produce a Z-axis magnetic field $H_z$. A conventional loop antenna that is planar, as seen in FIG. 1 will produce a strong magnetic field in the Z direction at the center of the loop antenna but weak magnetic fields in the X and Y directions.

It thus becomes difficult to generate a multi-directional field with conventional loop antennas without manipulation of the loop antenna or without using a multidimensional system with a plurality of loop antennas. If only one direction is recognized in the loop antenna, then detection of RFID tags across a wide area in many directions with one loop antenna would prove to be difficult.

Further, regarding the generated magnetic field along a particular direction, the magnetic field drops drastically when measured at a point outside of the center of the loop of a convention loop antenna, and further drops when measured outside of the loop antenna itself. This is because the magnetic field of a loop antenna is reciprocally proportional to the distance measured along, e.g., a perpendicular axis. For example, in an RFID loop antenna that is, e.g. circular-loop shaped, as the magnetic field may be generated along an axis perpendicular to the RFID loop antenna body, such antenna would experience a dramatic drop of magnetic field the farther away the field is measured from the center of the loop.

FIG. 2 shows a typical plot of the magnetic field generated when measured from a conventional loop antenna according to FIG. 1. The magnetic field values in the Z-axis direction are measured with respect to the position along the X-axis. According to FIG. 2, the magnetic field $H_z$ is shown to be strong in the middle of the X-Y plane. Outside the X-Y plane of the loop antenna of FIG. 1, the magnetic field in the Z-axis direction drops considerably. The loop antenna would not be able to provide a constant magnetic field across the loop antenna area. Experimental results have measured the Z-plane magnetic field decreasing to zero right above a conventional loop antenna conductor. Accordingly, the drop in the magnetic field may be such that an RFID tag at a particular short-range distance may not be picked up. Read range is limited, especially with un-tuned RFID tags, which typically require a higher field strength to work.

Further, RFID antennas experience null zones, where RFID tags placed within such zones will not be detected by the antenna. Thus, given the limitations of a conventional loop antenna, it becomes necessary but costly to include multiple loop antennas for complete coverage of an area of detection.

Solution to Problem

The present invention addresses at least the above disadvantages, and a general purpose of an embodiment of the invention is to provide an antenna system that reduces cost and extends the read volume of RFID tags to provide quick and accurate data reading.

According to one embodiment of the invention, an antenna may be realized that produces a uniform magnetic field that expands the strength beyond one dimensional axis.

Another embodiment of the present invention is to provide a multi-dimensional antenna capable of generating a magnetic field in at least two directions.

To achieve these and other advantages and in accordance with the purpose of the present invention, as embodied and described herein, an antenna is provided using at least two or more electroconductive sheets of uniform planar size with a space therein between may make an antenna. Said electroconductive sheets receive an electrical current from a feed to supply current to each sheet so as to form an electrical pathway of a circuit. Such pathway is equal distance for each conductive sheet. The two or more electroconductive sheets are connected together to complete the circuit, which causes direction of electrical flow in the one electroconductive sheet to be opposite to direction of electric flow in the other electroconductive sheet. Thus, a magnetic field may be created over an area greater than that measured from one axis. Multiple supply points, which supply current at evenly spaced locations on an electrical sheet, may allow formation of a uniform magnetic field between each sheet.

In addition, each electroconductive sheet may contain not only a first set of supply points, but a second set of supply points orthogonal to the first set. In this manner, two respective electrical pathways of a circuit may be created for each edge of an electroconductive sheet. The two electroconductive sheets are likewise connected together to complete a circuit that causes direction of electrical flow in the one electroconductive sheet to be opposite to direction of electric flow in the other electroconductive sheet. The feed of electrical current is alternately switched between the feed connection point of the first edge set and the feed connection point of the second edge set in a periodic manner, and the electrical current is switched in a uniform manner between the electroconductive sheets to create two magnetic fields that are orthogonal to each other.

A further embodiment of the present invention relates to a stacked multi-antenna system of smart shelves, comprising at least three electroconductive plates that operate together to generate a magnetic field. By switching current between the electroconductive sheets, multiple magnetic fields may be generated.

The RFID antenna may be formed as part of a product, including the RFID reader system, and the product may be implemented as a portable product.

Optional combinations of the aforementioned constituting elements and implementations of the invention in the form of methods, apparatuses, or systems may also be practiced as additional modes of the present invention.

Advantageous Effects of Invention

According to the present invention, a uniform magnetic field may be realized inside an RFID sheet antenna volume with reduced cost and extended the read volume of RFID tags.

BRIEF DESCRIPTION OF DRAWINGS

Embodiments will now be described, by way of example only, with reference to the accompanying drawings, which are meant to be exemplary, not limiting, and wherein like elements are numbered alike in several figures, in which:

FIG. 1 is an illustrative view of a magnetic field generated along the planar loop of a conventional antenna;

FIG. 2 is a measurement of the magnetic field drop off of the antenna of FIG. 1;

FIG. 3 is an RFID system including a base station and RFID tags;

FIG. 4 is a section view of the antenna according to one embodiment of the present invention;

FIG. 5A is an illustrative view of the magnetic field generated from the antenna of FIG. 4 when current flows clockwise;

FIG. 5B is an illustrative view of the magnetic field generated from the antenna of FIG. 4 when current flows counterclockwise;

FIG. 5C is an illustrative view of the magnetic field density of an electroconductive sheet of the antenna of FIG. 4;

FIG. 6 is a section view of the antenna according to another embodiment of the present invention;

FIG. 7 is a view of the electrical current supply according to FIG. 6;

FIG. 8 is a top illustrative view of the embodiment of FIG. 6;

FIG. 9 is a section view of the electroconductive sheet according to the embodiment of FIG. 6;

FIG. 10 is a measurement of the magnetic field drop off of the antenna of FIG. 6;

FIG. 11 is a section view of the antenna according to another embodiment of the present invention;

FIG. 12A is a top illustrative view of the embodiment of FIG. 11 with an $H_x$ field current driver;

FIG. 12B is a top illustrative view of the embodiment of FIG. 11 with an $H_y$ field current driver;

FIG. 13 is a variation of the embodiment of FIG. 11; and

FIG. 14 is a view of the RFID system with an antenna according to another embodiment of the present invention.

DESCRIPTION OF EMBODIMENTS

The invention will now be described by reference to the preferred embodiments. This does not intend to limit the scope of the present invention but to exemplify the invention. The size of the component in each figure may be changed in order to aid understanding. The orientation of a component in each figure may be illustrative and may further change in order to aid understanding. Some of the components in each figure may be omitted if they are not important for explanation.

FIG. 3 shows a block diagram of an RFID system 10 utilizing the RFID antenna according to various embodiments of the invention. An RFID base station 20 includes, in part, a reader 50, which acts as a control for the base station 20 to operate and correspond with one or more RFID tags 60. The reader 50 controls the functionality of the base station 20 and may correspond with an external computer, monitor, or display 36, which allows a user to interface with the base station 20. The reader 50 includes a controller 30 and a radio wave frequency interface 40 (herein known as "RF interface 40").

The controller 30 comprises a control unit 34 and memory 32. The control unit 34 communicates with the RF interface 40 for operation of data transmission and data receipt to and from the RFID tags 60. The memory 32 can store application information for the base station 20 or identification information of an RFID tag 60, e.g., tag identification numbers.

The RF interface 40 includes a receiver 42 and a transmitter 44. The receiver 42 and transmitter 44 allow the base station 20 to receive and transmit information, respectively.

In reading an RFID tag 60, the base station 20 will interrogate a tag by generating an RF signal (or "radio frequency signal") over a carrier frequency. The RF signal is coupled to an antenna 100, from which the RF signal is emitted and picked up by an antenna 62 of the RFID tag 60. Successful recognition of an RFID tag will ostensibly occur if the RFID tag 60 is located in a "read zone" that is defined by the base station 20. The read zone is within a transmitting range of the base station 20.

With the transmitter 44, the base station 20 may transmit an RF signal to interrogate the receiving RFID tag 60. For reading such tags, the antenna 100 of the base station generates and transmits a carrier signal of continuous electromagnetic waves. The RFID tags 60 will respond by modulating the carrier signal with information contained within the RFID tag. The modulated carrier signal is then sent back to the base station 20 and recognized by the receiver 42 via the antenna 100.

The antenna itself transmits carrier waves through a magnetic field, powered in part by the RF interface 40 through a modulator (not shown) of the receiver 42 and transmitter 44. The antenna of the invention acts as a multidimensional antenna. Instead of using a planar wire loop of conventional loop antennas, an antenna is formed from an electric circuit, in part, over a wider area to produce a substantial magnetic field. A more substantial magnetic field may consequently produce a larger read zone.

First Embodiment

FIG. 4 is a perspective side view of the antenna 100 according to a first embodiment. The antenna 100 comprises a plurality of electroconductive sheets 120. For purposes of explanation, the embodiment will refer to two electroconductive sheets 120*a* and 120*b*. Said electroconductive sheets 120, alternatively known as "sheets," "surfaces," "plates," or "units," may be made out of a material that has a low resistance R value. In a preferred embodiment of the invention, the antenna 100 is made from aluminum-based metal sheets, which are a cost-saving and effective option. The antenna 100 may also be fashioned from the housing of a conventional loop antenna system if the housing is made from a low-resistance electroconductive material.

The electroconductive sheets 120*a* and 120*b* are planar and formed to be uniform in size. The electroconductive sheets 120 are further parallel and aligned with respect to one another. A space is formed therein between, with the electroconductive sheets 120 themselves supported with an internal or external support structure (not pictured) made of non-conductive materials. The alignment of the electroconductive sheets 120 is not affected by the support structure.

Each electroconductive sheet 120 includes at least two connection points 130: a feed connection point 130*a*, and a return connection point 130*b*.

The feed connection point 130*a* (alternatively known as "feed point 130*a*") connects to one edge of an electroconductive sheet 120 and originally receives an electrical current, e.g., from an electrical feed 110 so as to supply current thereto. An "edge" of the electroconductive sheet 120 may be the physical edge of the plane of the electroconductive sheet 120, or may be, e.g., an overhanging portion connected to the edge of the sheet.

The return connection point 130*b* (alternatively known as a "return point 130*b*," "return," or "sink point") is located on another edge of the electroconductive sheet 120, opposite and parallel to the one edge of the electroconductive sheet 120 to which the feed connection point 130*a* is connected. The return point 130*b* acquires the electrical current from the electroconductive sheet 120 that was given by the feed point 130*a*.

The electroconductive sheets 120 are connected together with a connection 160, which is any connecting means such as a substrate, wire, or cable. Using the two electroconductive sheets 120*a* and 120*b*, an electrical pathway of a circuit may be created from the feed point 130*a* and return point 130*b* of one electroconductive sheet 120*a*, to the feed connection point 130*a* and return point 130*b* of another electroconductive sheet 120*b*. That is, the two electroconductive sheets 120 are connected together to complete a circuit, which causes the direction of electrical flow of current in the one electroconductive sheet 120*a* to be opposite to direction of electric flow of current in the other electroconductive sheet 120*b*.

As previously stated, the electrical circuit of the antenna 100 of the invention is given supply current $I_0$ from the modulator (not shown) of either the receiver 42 or the transmitter 44 of the RF interface 40. The feed 110 of electrical current to the antenna 100 is AC at, e.g., 13.56 MHz frequency, which is an RFID industry standard. The AC feed 110 provides electrical current to one electroconductive sheet 120*a*, 120*b* and returns the current from the other electroconductive sheet 120*b*, 120*a*.

It can be appreciated by those skilled in the art that by utilizing an AC power signal, the current alternates direction so that connection points 130 of an electroconductive sheet 120 may act as both a feed and a return. As such, the circuit may alternate the direction of the current flow such that a feed connection point 130*a* may also act as a return connection point 130*b* in an electroconductive sheet 120 in a subsequent alteration or current cycle.

Along the connection 160, opposing the feed 110 in the circuit is a tuning element 140. When the electrical current reaches the return point 130*b* of an electroconductive sheet 120*a*, the electrical current is supplied to another electroconductive sheet 120*b* by its feed connecting point via the tuning element 140. The tuning element 140 acts as a return such that, not only is a respective feed point 130*a* and a respective return point 130*b* equal distance for each electroconductive sheet 120*a* and 120*b*, the electrical pathway for each sheet 120 will be the same. That is, the current provided in each respective feed point 130*a* will be the same measurement. The tuning element 140 is placed so as to be equal distance from the AC power feed 110 via either electroconductive sheet 120.

FIGS. 5A and B are illustrative examples of the magnetic field H, or H field, generated by the antenna of the present embodiment. FIG. 5A illustrations when current flows "clockwise" through the sheet antenna 100, and FIG. 5B illustrations when current flows "counter-clockwise" through the sheet antenna 100. It should be noted that the directions along the Cartesian coordinate system are meant to be illustrative and in no way mean to limit the embodiments of the invention. The illustrative purpose is to show the relationship of the electrical current flow and subsequent magnetic field generated.

From FIG. 5A, the electroconductive sheets 120 are shown as placed along the X-Y plane. As the feed 110 provides current to the feed point 130*a* of electroconductive sheet 120*a*, current $I_x$ moves along the X-axis towards the return point 130*b*. Current flows in a path from minimum resistance for a circuit, so the return point 130*b* will be typically parallel to, i.e., in a straight line from, the feed point 130*a*. Subsequently, current is provided from the return point 130*b* of electroconductive sheet 120*a* via the tuner 140 to the feed point 130*a* of electroconductive sheet 120*b*; the current $-I_z$ is transmitted through sheets along the Z-axis in the −Z direction. Current $-I_x$ is directed through the electroconductive sheet 120*b* and is returned from the return point 130*b* of electroconductive sheet 120*b* in the −X direction to complete a circuit. The magnetic field $H_y$ generated from the antenna 100 is in the +Y direction along the Y-axis, according to Ampere's Law.

FIG. 5B illustrates the case when the current is supplied first to electroconductive sheet 120*b*. In this example, the electric current $I_z$ is transmitted between the two electroconductive sheets 120 in the +Z direction. A magnetic field $-H_y$ is subsequently generated from the antenna 100 in the −Y direction along the Y-axis. However, for the purposes of RFID tag detection, an H field generated in the positive coordinate direction is the same as that generated in the negative coordinate direction. That is, in the FIGS. 5A and 5B, the −Y direction H field $-H_y$ is the same as the +Y direction H field $H_y$. The connection points 130 of a respective sheet 120 may both feed current and return current, depending on the direction of the alternating current feed 110.

In the antenna 100 of FIGS. 5A and 5B, a near uniform H field can be created in the direction along the Y-axis. Due to the combination of a low resistance electroconductive sheet and even current distribution between such sheets, the H field inside the antenna's sheet volume, i.e., between the two electroconductive sheets, is near constant and may gradually decrease when moving away from the antenna 100. Experimental results have shown that some residual fields may exist on top and bottom of the antenna's sheet volume due to, e.g., fringing fields generated from an antenna's sheet edge. However, the magnetic field outside the antenna's sheet volume along the Z-axis is ideally measured at zero.

It is noted that, as the size of the antenna 100 increases, there may be an effect of current distribution across an electroconductive sheet 120 not being even. In the case of a single feed point 130*a*, the density of the current is higher at the feed point 130*a* and decreases rapidly along either side of the feed.

FIG. 5C is a top view of an electroconductive sheet 120 illustrating the distribution of current along the X-Y plane. If current is illustrated to flow as directed in the X-axis, with a feeding point 130*a* at the center, along the Y-axis, of the electroconductive sheet 120, current density is at a minimum along the edge of either side of the feeding point 130*a*. As seen from FIG. 50, the current along the edge of the feed point 130*a* becomes less dense the farther away from the feed point 130*a*, and also said current is comparatively less dense than the current measured at the edge of the return point 130*b*. As a generated magnetic field is understood to be proportional to the current density, the magnetic field will decrease the farther away it gets from the feeding point 130*a* when measured along the X-axis and Y-axis.

The effects of the aforementioned may be negligible in antennas with smaller-sized electroconductive sheets 120, but the effect is noticeable and critical for a larger physical antenna with a greater sheet volume, e.g., at a size of 600 mm by 400 mm.

FIG. 6 shows an alternative configuration of the first embodiment of the invention. The antenna 200 comprises two sheets 220, including a plurality of feed points 230*a* and a plurality of return points 230*b*. The feed points 230*a* and return points 230*b* are directly proportional in number with respect to each electroconductive sheet 220. FIG. 6 illustrates two feed points 230*a* and two return points 230*b*, but this number is not limited to two and may include multiple connection points for each electroconductive sheet 220.

As current is provided from the RF interface 40 as a feed 210, transformers 270 are used to split the input and to provide equal current to each feed point 230*a* of a sheet 220. Splitting into multiple flows of current creates multiple electronic pathways. Each current pathway is then returned by being steered into a corresponding return point 230*b*. The current of each pathway is subsequently transferred to another electroconductive sheet 220 via connectors 260, with respective tuning elements 240. It is noted that the tuning elements 240 are measured from the feed 210 to be equal distance for each electroconductive sheet 220. This is to ensure that there are equal pathways of current flow between each return point 230*b*.

FIG. 7 is an electronic schematic of a broadband transformer power splitter used as a transformer 270 for a feed 210. By illustration, four feed points 230*a* are provided. By splitting with transformers, the current may be evenly distributed to the multiple feed points 230*a* of an electroconductive sheet 220 (not shown).

FIG. 8 is a top view showing the flow of current of one electroconductive sheet 220. As by illustration, as part of the electric circuit, current $I_x$ flows along the sheet in the +X direction along the X-axis. With a completed electric circuit, a magnetic field $H_y$ is generated along the Y-axis, in this case, in the +Y direction. The connection between the feed points 230*a* and the return points 230*b* uniformly steers current along the electroconductive sheet 220 itself. The multiple connection points 230 may or may not be evenly spaced with respect to one another, but may be configured in a formation so as to achieve the desired result of an even magnetic field. A uniform magnetic field can thus be achieved in a large dimension antenna.

A current flowing down a very long electroconductive sheet will create a near-uniform magnetic field above the sheet surface for most of its length. FIG. 9 shows the magnetic field $B_y$ across an electroconductive sheet 220 along the X-Y plane. At any point P inside the sheet volume, the magnetic field B is experimentally measured as nearly constant, and can be valued according to $B=\mu_0 J_0 b/2$, with the magnetic constant $\mu_0$, measure of current $J_0$, and a sheet with material thickness b.

FIG. 10 shows the measurement of the magnetic field $H_y$ for the variation of the antenna 200 of the first embodiment. As previously stated, when measured directly above and below the electroconductive sheets 220 (along the Z-axis), the magnetic field strength is ideally measured as zero, with some residual field interference. From an X-Y planar perspective, outside the edges of the electroconductive sheets 220, the magnetic field drops off as $1/R^3$ in near field, and 1/R in far field. For example, at the frequency of 13.56 MHz, the magnetic near field ends approximately at 3.5 m from the antenna of the invention. However, a uniform magnetic field may be generated inside the sheet volume of the antenna 200, as shown in FIG. 10. This has an advantage over conventional RFID loop antennas because the magnetic field is substantially stronger over a wider coordinate area in the invention.

Second Embodiment

The first embodiment describes the case where an antenna is able to generate a uniform magnetic field in one direction along the Cartesian coordinate system. The second embodiment describes an antenna that is able to generate a magnetic field in multiple directions.

FIG. 11 is a perspective side view of an antenna 300 according to the second embodiment. The antenna 300 comprises of a plurality of electroconductive sheets 320. As from the figure, two electroconductive sheets 320*a* and 320*b* are illustrated.

The electroconductive sheets 320*a* and 320*b* are further planar and formed to be uniform in size, with a space formed therein between, as in the first embodiment. It is recognized that the electroconductive sheets 320 are formed to be rectangular such that they have two parallel sets of edges, a first edge set 322, and a second edge set 324, orthogonal to the first edge set 322. Each of the first and second edge sets may be interchangeable with respect to position on the electroconductive sheet 320, so long as the edge sets are orthogonal to each other. The electroconductive sheets 320 are aligned with each other, as in the first embodiment.

Each set of parallel edges 322, 324 includes one or more feed connection points 330*a*, 350*a* and a corresponding number of return connection points 330*b*, 350*b*, respectively. As illustrated from FIG. 11, the first edge set 322 has feed connection points 330*a* and return connection points 330*b*; the second edge set 324 has feed connection points 350*a* and return connection points 350*b*.

A feed 310 provides current to the feed connection points 330*a* of a first edge set 322 or the feed connection points 350*a* of a second edge set 324. Like the first embodiment, an electrical pathway is created between feed points 330*a*, 350*a* and return points 330*b*, 350*b*, respectively, for each electroconductive sheet 320. Connectors 360 and tuning elements 340 help boost the current between the two electroconductive sheets 320.

Using feed points 330*a*, 350*a* and return points 330*b*, 350*b* at orthogonal edges of the electroconductive sheet 320, the feed 310 may distribute current in multiple directions along the X-Y axes. The feed 310 drives current alternatively to produce an H field in the Y-axis direction (hereinafter, the "$H_y$ field current driver 310*a*") and to produce an H field in the X-axis direction (hereinafter, the "$H_x$ field current driver 310*b*"). Electrical current may be alternately switched between the feeds 310 of the feed points 330*a*, 350*a* so that only one edge set of a sheet will be supplied with electrical current at a time. In this manner, current will be periodically given to the feed points 330*a*, 350*a* so that current is switched in a uniform manner between each electroconductive sheet 320. The speed of switching between feeds 310 may realize an antenna 300 that may quickly generate a magnetic field in multiple directions.

FIGS. 12A and 12B are top views of the antenna 300 that illustrate the switching of current in the configuration of the second embodiment. From FIG. 12A, current $I_x$ is supplied to the feed points 330*a* in the +X direction along the X-axis. Like the antenna 100 of the first embodiment, a magnetic field is generated that is perpendicular to the current flow; in this case, the magnetic field $H_y$ is in the +Y direction along the Y-axis.

FIG. 12B shows the antenna 300 when the feed 310 is switched to drive current $I_y$ to the feed points 350*a* in the +Y direction along the Y-axis. Continuing the electric circuit, a magnetic field $-H_x$ may be generated in the −X direction along the X-axis.

The above configuration realizes two electric circuits. The circuits will be active at a time and cycled through in sequence. By periodically switching current feeds to the antenna in the directions along the, e.g., X and Y axes, a magnetic field may be likewise generated for the directions of the Y or X axes, respectively. Thus, it becomes possible to generate a magnetic field in two directions without, e.g., a secondary antenna, thus saving time and resources while expanding the scope of the read zone for the RFID antenna.

Both the first and second embodiment may be stationary, or may be made as a portable antenna system, such as that shown in FIG. 13. Any portable means, such as wheels or mobile components 570, may be added to the antenna volume. The base station 20 may be part of an overall portable system where a large antenna 500 of the configuration of, e.g., the second embodiment, is placed to generate a greater magnetic field.

Third Embodiment

As presented, a uniform magnetic field may be generated from the antennas of the first and second embodiment. In order to increase the read zone to be even greater, a method has been employed to stack antennas onto one another so that the H field may be generated in one or more directions, and propagated along the Z-axis. The stacked antenna 600 may be stationary or made portable through mobile components 670.

To create a stacked antenna 600, multiple antennas of the first and/or second embodiment may be placed onto each other along the Z-axis. Multiple electroconductive sheets 120 for the stacked antenna 600 may be used. However, it is realized that certain redundancy may occur with the electroconductive sheets 120 that adjoin one another in the antenna stack. Therefore, a third embodiment of the invention realizes a stacked antenna any variation of embodiment 1 and/or embodiment 2 that avoids sheet redundancy.

FIG. 14 is an example of an antenna 600 of the third embodiment, using a layout of the first embodiment for illustrative purposes. The stacked antenna may employ at least three electroconductive sheets for the desired effect to generate multiple H fields. In the figure, four electroconductive sheets 120 are illustrated. However, the number of the antenna 600 is not limited to four. The electroconductive sheets 120 are configured so that either the "middle" stacked electroconductive sheets 120*b* and 120*c* may act as both a "driving" sheet where current is driven or a "return" sheet where current is returned, i.e., an antenna of the first embodiment (or second embodiment) may be created with electroconductive sheets 120*a* and 120*b*, 120*b* and 120*c*, and 120*c* and 120*d*.

The feed 610 of the antenna 600 uses a transformer and switches the current supply so as to drive current to the feed points 130*a* of individual sheets 120. Timing the supply of current in an appropriate manner will utilize each sheet 120 in such a manner as to create multiple magnetic fields. By using the switches, as illustrated in FIG. 14, there is no conflict of current flow between the electroconductive sheets 120.

It will be understood to a skilled person that the functions achieved by the constituting elements recited in the claims are implemented either alone or in combination by the constituting elements shown in the embodiment and the variation.

INDUSTRIAL APPLICABILITY

The present invention can be used in the field of RFID tag detection and transmission and for use with RFID systems and systems necessitating the use of an antenna generating a magnetic field.

The invention claimed is:

1. An RFID tag reading antenna, comprising:

at least two planar electroconductive sheets spaced apart to form a space therein between defining an antenna read volume in which RFID tags to be read are receivable, each electroconductive sheet comprising:

a feed connection point, which receives an electrical current from a feed that supplies current to the electroconductive sheet;

a return connection point, which acquires the electrical current from the electroconductive sheet and transfers the electrical current to a return, wherein the at least two planar electroconductive sheets are conductively connected together to form an electrical circuit that includes the feed connection points and the return connection points of two of the planar electroconductive sheets when the two planar electroconductive sheets are connected to an electrical feed and such that a substantially uniform magnetic field is configured to be generated within the antenna read volume between the planar electroconductive sheets, the substantially uniform magnetic field extending substantially parallel to the planar electroconductive sheets.

2. The RFID antenna of claim 1, wherein the at least two planar electroconductive sheets are of uniform size and are positioned to be parallel and aligned with respect to one another.

3. The RFID antenna of claim 1, wherein the feed connection point and the return connection point of each electroconductive sheet are positioned at opposite edges of the sheet.

4. The RFID antenna of claim 1, wherein the electroconductive sheets are made with an aluminum-based metal.

5. An electrical current supplier that provides current to a feed of the RFID antenna of claim 1.

6. An RFID antenna, comprising:

at least two planar electroconductive sheets of uniform size spaced apart to form a space therein between defining an antenna read volume, wherein said electroconductive sheets are parallel and aligned with respect to one another, each electroconductive sheet comprising:

a first edge set and a second edge set of parallel edges, wherein the second edge set is orthogonal to the first edge set, each of the first edge set and second edge set including:

a feed connection point, which receives an electrical current from a feed that supplies current to the electroconductive sheet, the feed connection point connecting to one edge of the electroconductive sheet;

a return connection point, which acquires the electrical current from the electroconductive sheet and transfers the electrical current to a return, the return connection point connecting to another edge of the electroconductive sheet, opposite and parallel to the one edge of the electroconductive sheet to which the feed connection point is connected, wherein the electrical pathway of a circuit created from the feed to the return via a respective feed connection point and a respective return connection point is equal distance for each electroconductive sheet, wherein the at least two electroconductive sheets are connected together to complete a circuit that causes direction of electrical flow in the one electroconductive sheet to be opposite to direction of electric flow in the other electroconductive sheet, wherein the feed of electrical current is alternately switched between the feed connection point of the first edge set and the feed connection point of the second edge set in a periodic manner, and the electrical current is switched in a uniform manner between the electroconductive sheets.

7. The RFID antenna of claim 6, wherein a magnetic field is generated between the electroconductive sheets and said magnetic field is uniform in the space therein between.

8. The RFID antenna of claim 7, wherein the magnetic field changes direction in an orthogonal manner when the electrical current is switched between the feed connection points of the first edge set and the second edge set, respectively.

9. The RFID antenna of claim 8, wherein the first edge set and the second edge set each have a plurality of feed connection points and an equal number of respective return connection points, respectively.

10. The RFID antenna of claim 9, wherein the feed connection points and respective return connection points are evenly spaced, in each of the first edge set and the second edge set, with equal distance between each feed connection point and a respective return connection point, in parallel.

11. The RFID antenna of claim 6, wherein the electroconductive sheets are made with an aluminum-based metal.

12. A switch, which switches in a periodic manner the feed of electrical current to the feed connection points of the first edge set and second edge set of the electroconductive sheets of claim 6.

13. A method of producing an alternating magnetic field in an RFID antenna, the RFID antenna comprising:

at least two planar electroconductive sheets of uniform size spaced apart to form a space therein between defining an antenna read volume, wherein said electroconductive sheets are parallel and aligned with respect to one another, each electroconductive sheet comprising:

a first edge set and a second edge set of parallel edges, wherein the second edge set is orthogonal to the first edge set, each of the first edge set and second edge set including:

a feed connection point, which receives an electrical current from a feed that supplies current to the electroconductive sheet, the feed connection point connecting to one edge of the electroconductive sheet;

a return connection point, which acquires the electrical current from the electroconductive sheet and transfers the electrical current to a return, the return connection point connecting to another edge of the electroconductive sheet, opposite and parallel to the one edge of the electroconductive sheet to which the feed connection point is connected, wherein the electrical pathway of a circuit created from the feed to the return via a respective feed connection point and a respective return connection point is equal distance for each conductive sheet, the method comprising:

connecting the at least two electroconductive sheets together to complete a circuit that causes direction of electrical flow in the one electroconductive sheet to be opposite to direction of electric flow in the other electroconductive sheet, and switching the feed of electrical current between the feed connection point of the first edge set and the feed connection point of the second edge set in a periodic manner, the switching being uniform between the electroconductive sheets.

14. An RFID antenna, comprising:

at least two planar electroconductive sheets each electroconductive sheet comprising:

a feed connection point, which receives an electrical current from a feed that supplies current to the electroconductive sheet;

a return connection point, which acquires the electrical current from the electroconductive sheet and transfers the electrical current to a return;

wherein the at least two planar electroconductive sheets are conductively connected together to form an electrical circuit that includes the feed connection points and the return connection points of two of the planar electroconductive sheets when the two planar electroconductive sheets are connected to an electrical feed;

wherein the at least two planar electroconductive sheets are spaced apart to define an antenna read volume, wherein the feed connection point is spaced apart from the return connection point in a first direction, and wherein each electroconductive sheet further comprises:

a second feed connection point and a second return connection point, the second feed connection point spaced apart from the second return connection point in a second direction, different from the first direction; and a switch configured to alternately switch the electrical current between the feed connection point and the second feed connection point.

* * * * *